US007913416B1

(12) United States Patent
Scieri

(10) Patent No.: US 7,913,416 B1
(45) Date of Patent: Mar. 29, 2011

(54) PORTABLE HAIR DRYER OPTIMALLY HAVING A DUAL HEATING SOURCE

(76) Inventor: Frank Scieri, Deer Park, NY (US)

( * ) Notice: Subject to any disclaimer, the term of this patent is extended or adjusted under 35 U.S.C. 154(b) by 381 days.

(21) Appl. No.: 12/152,063

(22) Filed: May 12, 2008

(51) Int. Cl.
*A45D 20/12* (2006.01)

(52) U.S. Cl. ..... 34/97; 34/96

(58) Field of Classification Search ..... 34/96, 97; 219/222; 392/379–385
See application file for complete search history.

(56) References Cited

U.S. PATENT DOCUMENTS 4,556,782 A 12/1985 Fujishima et al.
4,726,767 A * 2/1988 Nakajima ..... 432/222
4,903,416 A * 2/1990 Levin et al. ..... 34/97
5,155,925 A 10/1992 Choi
5,195,253 A 3/1993 Poumey et al.
D369,434 S 4/1996 LeCompte, Sr.
5,608,975 A 3/1997 Hsu
5,857,262 A * 1/1999 Bonnema et al. ..... 34/97
6,314,236 B1 11/2001 Taylor

* cited by examiner

*Primary Examiner* — Jiping Lu
(74) *Attorney, Agent, or Firm* — Richard L. Miller

(57) ABSTRACT

A portable hair dryer optimally having a dual heating source. In a first embodiment, the heating source is gas utilizing a gas cartridge. In a second embodiment, the heating source is electricity utilizing a battery. In a third embodiment, the heating source is either gas, electricity, or both utilizing both a gas cartridge and a battery.

1 Claim, 3 Drawing Sheets

PORTABLE HAIR DRYER OPTIMALLY HAVING A DUAL HEATING SOURCE

1. BACKGROUND OF THE INVENTION

A. Field of the Invention

The embodiments of the present invention relate to a portable hair dryer, and more particularly, the embodiments of the present invention relate to a portable hair dryer optimally having a dual heating source.

B. Description of the Prior Art

Numerous innovations for portable hair dryers have been provided in the prior art that will be described below in chronological order to show advancement in the art, and which is incorporated herein by reference thereto. Even though these innovations may be suitable for the specific individual purposes to which they address, however, they differ from the present invention in that they do not teach a portable hair dryer optimally having a dual heating source.

(1) U.S. Pat. No. 4,556,782 to Fujishima et al.

U.S. Pat. No. 4,556,782 issued to Fujishima et al. on Dec. 3, 1985 in class 219 and subclass 370 teaches a foldable hair dryer of the hand-held type, which includes a housing incorporating an electrically operated apparatus for producing a flow of heated air, a hand grip pivotally attached to the housing, and a power cord extending from the housing. The hand grip is rotatable to an operational position where it extends outwardly from the housing, and to a folded position where it is folded on a part of periphery of the housing. Formed along the periphery of the housing is a first groove cooperating, when the hand grip is in the folded position, with the second groove formed in the hand grip to define a peripheral channel extending across the housing and the folded hand grip. The power cord can be received in the peripheral channel thus formed and be wound up along the entire periphery of the hair dryer when the hand grip is brought in the folded position. The hand grip is shaped to have a cap portion, which closes an air discharge outlet when it is in the folded position so as to prohibit the entry of foreign matter therethrough. Apparatus incorporated in the hair dryer for producing a flow of heated air is energized by the operation of a knob that is accessible from the exterior of the housing, and is locked in position not to energize the apparatus for producing a flow of heated air until the hand grip is brought in the operational position, thus preventing an accidental flow of heated air blown from the outlet when the hand grip is in the folded position, since such accidental flow would otherwise damage the hand grip and the power cord wound thereon.

(2) U.S. Pat. No. 5,155,925 to Choi.

U.S. Pat. No. 5,155,925 issued to Choi on Oct. 20, 1992 in class 34 and subclass 97 teaches a hair dryer available outdoors or where a general power source is not available, an LPG powered hair dryer is provided. The hair dryer includes a main body that can receive a bottle of LPG (liquified petroleum gas), and a burner in the main body for burning the LPG. The burner flame heats a double radiant plate arrangement in front of the burner, and hot air is blown from the plate arrangement by a battery powered fan motor at the rear of the housing. A gas-interrupting valve, a gas-adjusting valve, an operation switch, and a thermal sensor are also provided in the housing.

(3) U.S. Pat. No. 5,195,253 to Poumey et al.

U.S. Pat. No. 5,195,253 issued to Poumey et al. on Mar. 23, 1993 in class 34 and subclass 97 teaches a cordless electric hair dryer and stand in which the portable hair dryer unit has a rechargeable battery and a thermal heat reservoir. The fan blows ambient air over the thermal reservoir in heat exchange relationship to expel hot air from the dryer when in use. The stand has an electrical circuit inductively coupled through a coil in the base of the stand to a coil in the rear of the housing of the dryer, which provides power to charge the rechargeable battery in the handle of the dryer and to heat the thermal storage medium in the dryer. The heating is accomplished by resistors mounted in heat exchange relationship with the thermal reservoir material. The rechargeable battery is used only to run the fan during drying operation of the portable unit.

(4) U.S. Pat. No. Des. 369,434 to LeCompte, Sr.

U.S. Pat. No. Des. 369,434 issued to LeCompte, Sr. on Apr. 30, 1996 in class D28 and subclass 13 teaches the ornamental design for a rechargeable cordless hair dryer.

(5) U.S. Pat. No. 5,608,975 to Hsu.

U.S. Pat. No. 5,608,975 issued to Hsu on Mar. 11, 1997 in class 34 and subclass 97 teaches a collapsible and portable hair dryer with a gas combustion heat supply system. Gas combustion is adapted to supply heat for air inside the hair dryer. A motor ran by a self-contained power source system rotates a fan in order to blow air through several blade-like portions, which are heated by the gas flame. Thus, the air passed through the heated blade-like portions becomes hot and is blown out for use. The hair dryer can be used outdoors because an electrical socket is not needed.

(6) U.S. Pat. No. 6,314,236 to Taylor.

U.S. Pat. No. 6,314,236 issued to Taylor on Nov. 6, 2001 in class 392 and subclass 385 teaches a hair dryer having a heater, a fan positioned to form an air flow that is heated by the heater, a battery, and a switch connected in circuit with the fan and the battery. An interlock prevents the switch from closing during the time the hair dryer is inserted in a base for charging the battery and heating the heater via an electrical power source. An arc prevention assembly prevents arcing among contacts on the hair dryer and the base during insertion and removal of the dryer to and from the base.

It is apparent that numerous innovations for portable hair dryers have been provided in the prior art that are adapted to be used. Furthermore, even though these innovations may be suitable for the specific individual purposes to which they address, however, they would not be suitable for the purposes of the embodiments of the present invention as heretofore described, namely, a portable hair dryer optimally having a dual heating source.

2. SUMMARY OF THE INVENTION

Thus, an object of the embodiments of the present invention is to provide a portable hair dryer optimally having a dual heating source, which avoids the disadvantages of the prior art.

Briefly stated, another object of the embodiments of the present invention is to provide a portable hair dryer optimally having a dual heating source. In a first embodiment, the heating source is gas utilizing a gas cartridge. In a second embodiment, the heating source is electricity utilizing a battery. In a third embodiment; the heating source is either gas, electricity, or both utilizing both a gas cartridge and a battery.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
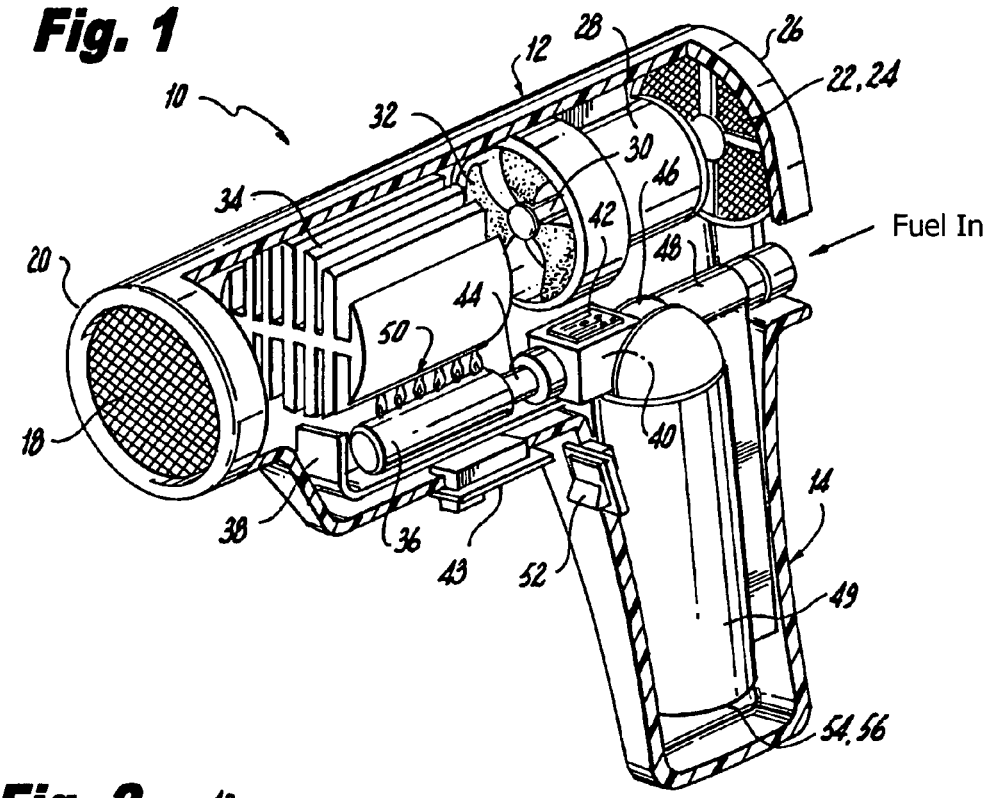
FIG. 1 is a diagrammatic perspective view with parts broken away of a first embodiment of the portable hair dryer of the present invention utilizing a gas heating source.

A. First Embodiment of Portable Hair Dryer 10

| | |
|---|---|
| 10 | portable hair dryer of present invention |
| 12 | main body |
| 14 | handle part |
| 16 | bottom of main body 12 |
| 18 | air outlet of main body 12 |
| 20 | front end of main body 12 |
| 22 | air inlet |
| 24 | net of air inlet 22 |
| 26 | rear end of main body 12 |
| 28 | motor |
| 30 | transmission shaft of motor 28 |
| 32 | fan |
| 34 | blade-like heat exchanger for absorbing heat 35 from gas combustion |
| 35 | heat from gas combustion |
| 36 | combustion chamber for gas to be combusted therein |
| 38 | temperature sensor |
| 40 | valve for controlling outflow quantity of gas 44 |
| 42 | computer microchip |
| 43 | temperature selector for controlling temperature of portable hair dryer 10 |
| 44 | outflow quantity of gas |
| 46 | front end of gas pipe 48 |
| 48 | gas pipe for receiving gas cartridge 49 |
| 49 | gas cartridge |
| 50 | flame nozzle |
| 52 | ON/OFF |
| 54 | electrical power source interface for receiving battery 56 for electrically powering portable hair dryer 10 |

B. Second Embodiment of Portable Hair Dryer 100

| | |
|---|---|
| 100 | portable hair dryer of present invention |
| 120 | main body |
| 140 | handle part |
| 160 | bottom of main body 120 |
| 180 | air outlet of main body 120 |
| 200 | front end of main body 120 |
| 220 | air inlet of main body 120 |
| 240 | net of air inlet 220 of main body 120 |
| 260 | rear end of main body 120 |
| 280 | motor |

-continued

| | |
|---|---|
| 300 | transmission shaft of motor 280 |
| 320 | fan |
| 340 | heating coil heat exchanger for generating heat 350 |
| 350 | heat |
| 380 | temperature sensor |
| 430 | temperature selector for controlling temperature of portable hair dryer 100 |
| 440 | outflow quantity of electricity |
| 520 | ON/OFF |
| 540 | electrical power source interface for receiving battery 560 for electrically powering portable hair dryer 100 |
| 560 | battery for electrically powering portable hair dryer 100 |
| 562 | battery charger for charging battery 560 by interfacing with either vehicle outlet jack 564 or house current outlet 566 |
| 564 | vehicle outlet jack 564 |
| 566 | house current outlet |

C. Third Embodiment of Portable Hair Dryer 600

| | |
|---|---|
| 600 | portable hair dryer of present invention |
| 602 | main body |
| 604 | handle part |
| 606 | bottom of main body 602 |
| 608 | air outlet of main body 602 |
| 610 | front end of main body 602 |
| 612 | air inlet of main body 602 |
| 614 | net of air inlet 612 of main body 602 |
| 616 | rear end of main body 602 |
| 618 | motor |
| 620 | transmission shaft of motor 618 |
| 622 | fan |
| 624 | heating coil heat exchanger for generating heat 626 |
| 626 | heat |
| 628 | combustion chamber for gas to be combusted therein |
| 630 | temperature sensor |
| 632 | valve for controlling outflow quantity of gas 638 |
| 634 | computer microchip |
| 636 | temperature selector for controlling temperature of portable hair dryer 600 |
| 638 | outflow quantity of gas |
| 640 | gas pipe for receiving gas cartridge 642 |
| 642 | gas cartridge |
| 644 | flame nozzle |
| 646 | ON/OFF switch |
| 648 | electrical power source interface for receiving battery 650 for electrically powering portable hair dryer 600 |
| 650 | battery |
| 652 | battery charger for charging battery 5650 |
| 654 | vehicle outlet jack |
| 656 | house current outlet |
| 658 | mode switch for choosing for use either electrical, gas, or both |

5. DETAILED DESCRIPTION OF THE PREFERRED EMBODIMENTS

A. The First Embodiment of the Portable Hair Dryer 10

Figure 2:
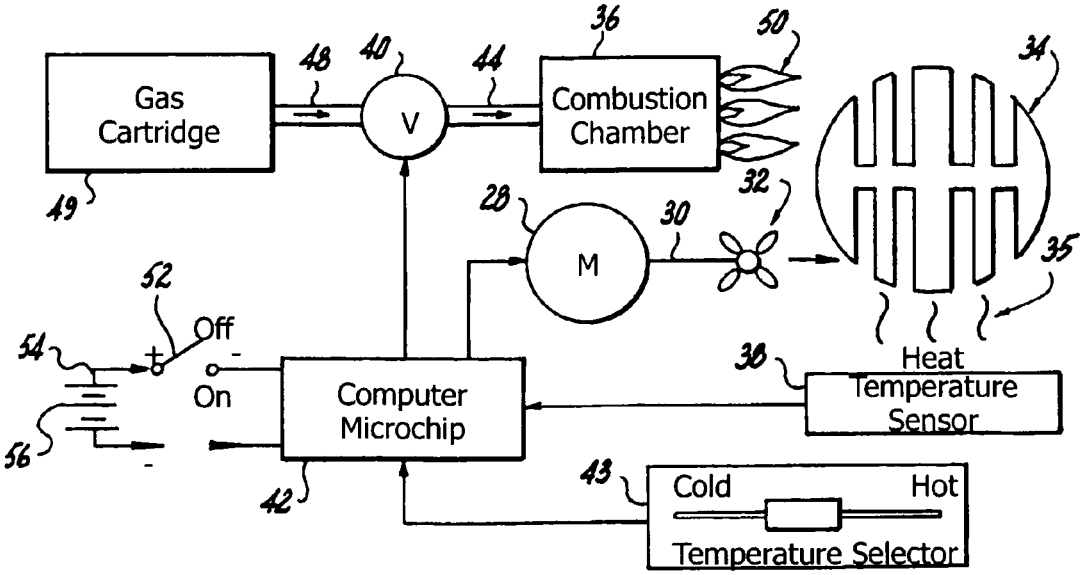
FIG. 2 is a block diagram of the portable hair dryer of the embodiment of the present invention shown in FIG. 1.

Referring now to the figures, in which like numerals indicate like parts, and particularly to FIGS. 1 and 2, which are, respectively, a diagrammatic perspective view with parts broken away of a first embodiment of the portable hair dryer of the present invention utilizing a gas heating source, and a block diagram of the portable hair dryer of the embodiment of the present invention shown in FIG. 1, the first embodiment of the portable hair dryer of the present invention is shown generally at 10.

The portable hair dryer 10 comprises a main body 12 and a handle part 14. The handle part 12 is connected to a bottom 16 of the main body 12.

The main body 12 includes an air outlet 18. The air outlet 18 of the main body 12 is disposed at a front end 20 of the main body 12.

The main body 12 further includes an air inlet 22. The air inlet 22 of the main body 12 has a net 24 thereat and is disposed at a rear end 26 of the main body 12.

The portable hair dryer 10 further comprises a motor 28. The motor 28 is disposed inside the main body 12 and has a transmission shaft 30.

The main body 12 further includes a fan 32. The fan 32 is disposed on the transmission shaft 30 of the motor 28, and turns therewith.

The portable hair dryer 10 further comprises a blade-like heat exchanger 34. The blade-like heat exchanger 34 are disposed in front of the fan 32 and inside the main body 12, and are for absorbing heat 35 from gas combustion.

The portable hair dryer 10 further comprises a combustion chamber 36. The combustion chamber 36 is disposed under the blade-like heat exchanger 34, and is for gas to be combusted therein.

The portable hair dryer 10 further comprises a temperature sensor 38. The temperature sensor 38 is disposed below the blade-like heat exchanger 34, and is operationally associated with a valve 40 via a computer microchip 42.

The main body 12 further includes a temperature selector 43. The temperature selector 43 is operatively connected to the computer microchip 42 and is for controlling temperature of the portable hair dryer 10.

The valve 40 is for controlling outflow quantity of gas 44, and is connected with a front end 46 of a gas pipe 48 fitted on the bottom 16 of the main body 12, which in turn is for receiving a gas cartridge 49.

The portable hair dryer 10 further comprises a flame nozzle 50. The flame nozzle 50 is disposed in front of the valve 40.

The temperature selector 43 is operated by a user to set a desired temperature and the temperature sensor 38 senses a temperature to make the valve 40 move in accordance with the set desired temperature value such that the outflow quantity of gas 44 for combustion is adapted for the user's need.

The portable hair dryer 10 further comprises an ON/OFF switch 52. The ON/OFF 52 is disposed on the handle part 14, and is operatively connected to the computer microchip 42.

The portable hair dryer 10 further comprises an electrical power source interface 54. The electrical power source interface 54 is disposed in the handle part 14, and is for receiving a battery 56 for electrically powering the portable hair dryer 10.

B. The Second Embodiment of the Portable Hair Dryer 100

Figure 3:
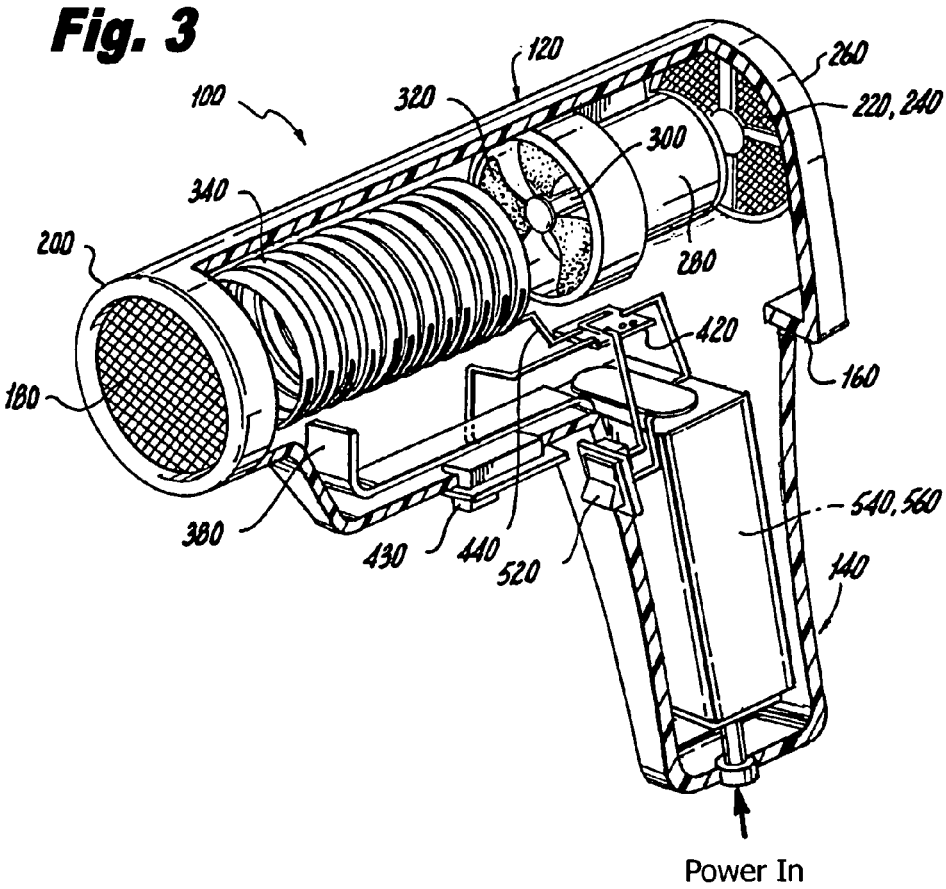
FIG. 3 is a diagrammatic perspective view with parts broken away of a second embodiment of the portable hair dryer of the present invention utilizing an electrical heating source.
Figure 4:
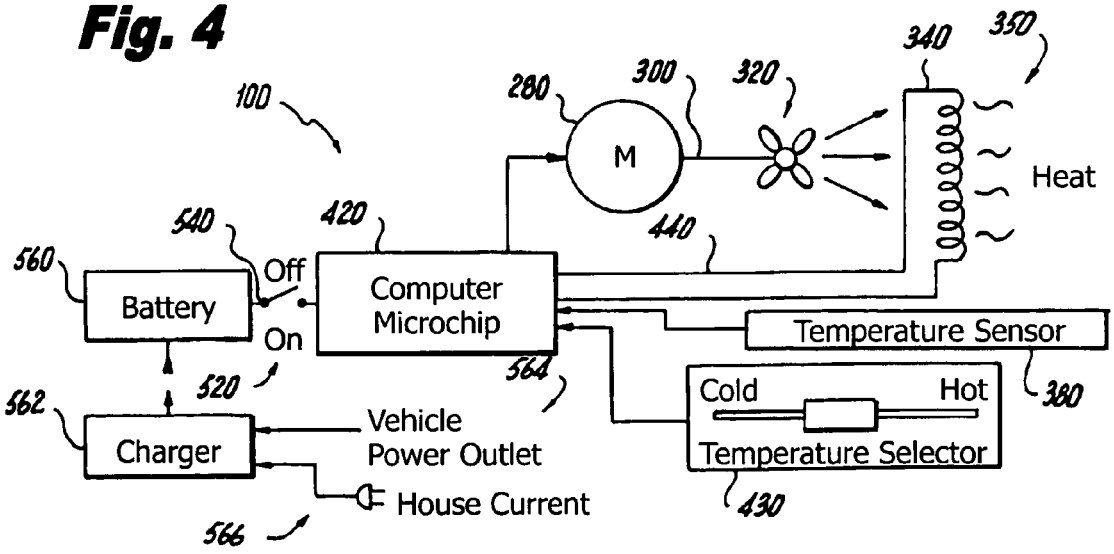
FIG. 4 is a block diagram of the portable hair dryer of the embodiment of the present invention shown in FIG. 3.

Referring now to the figures, in which like numerals indicate like parts, and particularly to FIGS. 3 and 4, which are, respectively, a diagrammatic perspective view with parts broken away of a second embodiment of the portable hair dryer of the present invention utilizing an electrical gas heating source, and a block diagram of the portable hair dryer of the embodiment of the present invention shown in FIG. 3, the second embodiment of the portable hair dryer of the present invention is shown generally at 100.

The portable hair dryer 100 comprises a main body 120 and a handle part 140. The handle part 140 is connected to a bottom 160 of the main body 120.

The main body 120 includes an air outlet 180. The air outlet 180 of the main body 120 is disposed at a front end 200 of the main body 120.

The main body 120 further includes an air inlet 220. The air inlet 220 of the main body 120 has a net 240 thereat and is disposed at a rear end 260 of the main body 120.

The portable hair dryer 100 further comprises a motor 280. The motor 280 is disposed inside the main body 120 and has a transmission shaft 300.

The main body 120 further includes a fan 320. The fan 320 is disposed on the transmission shaft 300 of the motor 280, and turns therewith.

The portable hair dryer 100 further comprises a heating coil heat exchanger 340. The heating coil heat exchanger 340 is disposed in front of the fan 320 and inside the main body 120, and is for generating heat 350.

The portable hair dryer 100 further comprises a temperature sensor 380. The temperature sensor 380 is disposed below the heating coil heat exchanger 340, and is operationally associated with a computer microchip 420.

The main body 120 further includes a temperature selector 430. The temperature selector 430 is operatively connected to the computer microchip 420 and is for controlling temperature of the portable hair dryer 100.

The temperature selector 430 is operated by a user to set a desired temperature, and the temperature sensor 380 senses a temperature to make the heating coil heat exchanger 340 be in accordance with the set desired temperature value such that the outflow quantity of electricity 440 to the heating coil heat exchanger 340 is adapted for the user's need.

The portable hair dryer 100 further comprises an ON/OFF switch 520. The ON/OFF 520 is disposed on the handle part 140, and is operatively connected to the computer microchip 420.

The portable hair dryer 100 further comprises an electrical power source interface 540. The electrical power source interface 540 is disposed in the handle part 140, and is for receiving a battery 560 for electrically powering the portable hair dryer 100.

The portable hair dryer 100 further comprises a battery charger 562. The battery charger 562 is operatively connected to the electrical power source interface 540, and is for charging the battery 560 by interfacing with either a vehicle outlet jack 564 or a house current outlet 566.

C. The Third Embodiment of the Portable Hair Dryer 600

Figure 5:
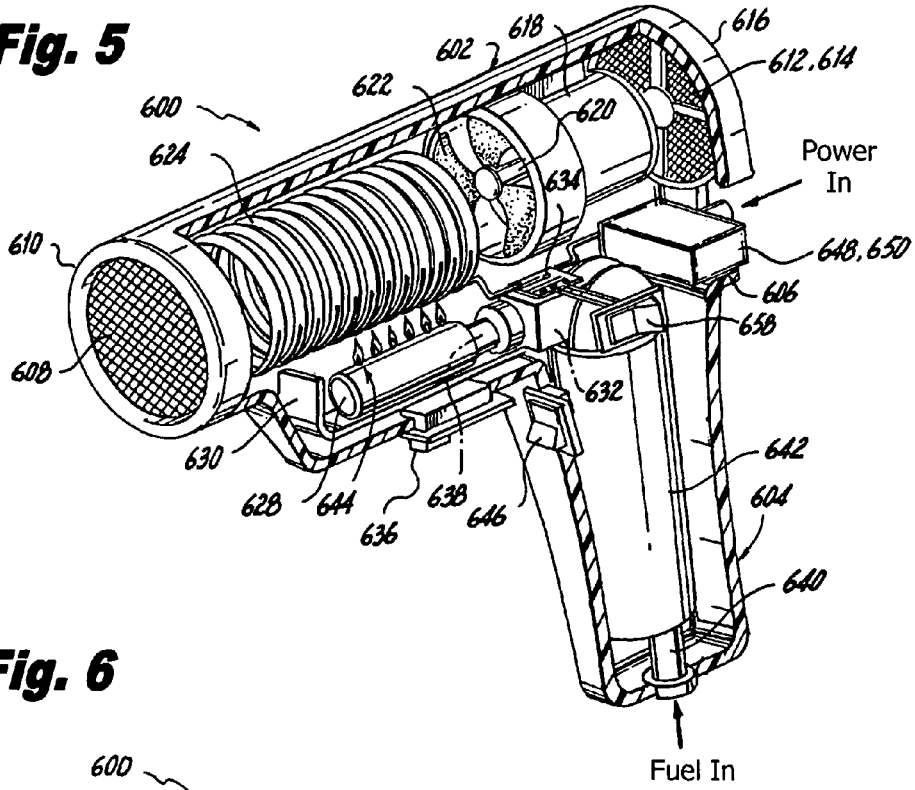
FIG. 5 is a diagrammatic perspective view with parts broken away of a third embodiment of the portable hair dryer of the present invention utilizing a gas heating source and an electrical heating source.
Figure 6:
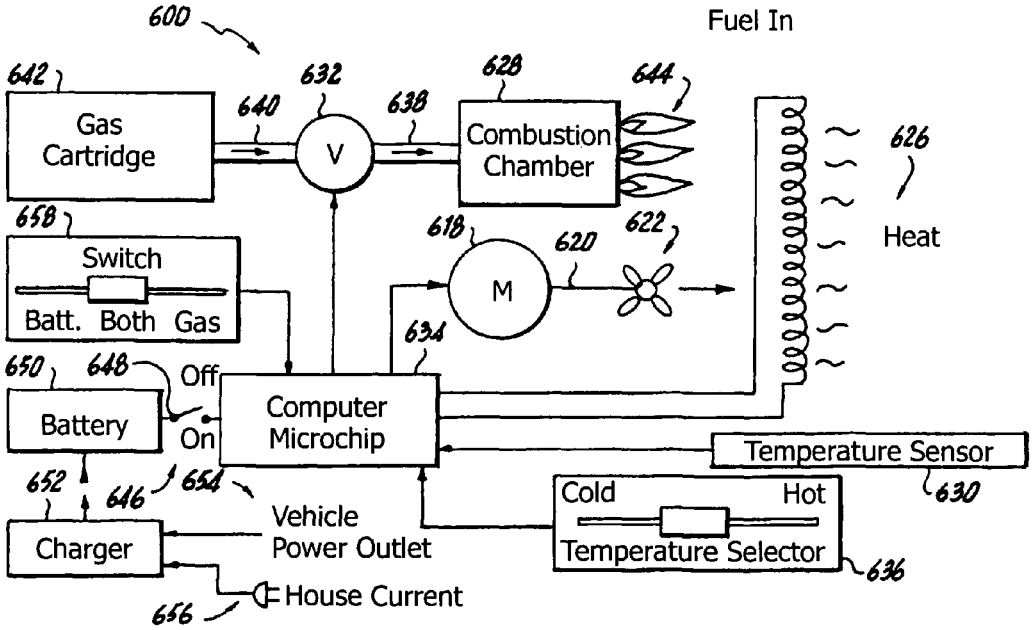
FIG. 6 is a block diagram of the portable hair dryer of the present invention shown in FIG. 5.

Referring now to the figures, in which like numerals indicate like parts, and particularly to FIGS. 5 and 6, which are, respectively, a diagrammatic perspective view with parts broken away of a third embodiment of the portable hair dryer of the present invention utilizing a gas heating source and an electrical heating source, and a block diagram of the portable hair dryer of the embodiment of the present invention shown in FIG. 5, the third embodiment of the portable hair dryer of the present invention is shown generally at 600.

The portable hair dryer 600 comprises both the portable hair dryer 10 and the portable hair dryer 100 so as to allow the portable hair dryer 600 to utilize either a gas heating source, an electrical heating source, or both.

The portable hair dryer 600 comprises a main body 602 and a handle part 604. The handle part 604 is connected to a bottom 606 of the main body 602.

The main body 602 includes an air outlet 608. The air outlet 608 of the main body 602 is disposed at a front end 610 of the main body 602.

The main body 602 further includes an air inlet 612. The air inlet 612 of the main body 602 has a net 614 thereat and is disposed at a rear end 616 of the main body 602.

The portable hair dryer 600 further comprises a motor 618. The motor 618 is disposed inside the main body 602 and has a transmission shaft 620.

The main body 602 further includes a fan 622. The fan 622 is disposed on the transmission shaft 620 of the motor 618, and turns therewith.

The portable hair dryer 600 further comprises a heating coil heat exchanger 624. The heating coil heat exchanger 624 is disposed in front of the fan 622 and inside the main body 602, and is for generating heat 626.

The portable hair dryer 600 further comprises a combustion chamber 628. The combustion chamber 628 is disposed under the heating coil heat exchanger 624, and is for gas to be combusted therein.

The portable hair dryer 600 further comprises a temperature sensor 630. The temperature sensor 630 is disposed below the heating coil heat exchanger 624, and is operationally associated with a valve 632 via a computer microchip 634.

The main body 602 further includes a temperature selector 636. The temperature selector 636 is operatively connected to the computer microchip 634 and is for controlling temperature of the portable hair dryer 600.

The valve 632 is for controlling outflow quantity of gas 638, and is connected with a gas pipe 640 fitted in the handle part 604, which in turn is for receiving a gas cartridge 642.

The portable hair dryer 600 further comprises a flame nozzle 644. The flame nozzle 644 is disposed in front of the valve 632.

The temperature selector 636 is operated by a user to set a desired temperature and the temperature sensor 630 senses a temperature to make the valve 632 move in accordance with the set desired temperature value such that the outflow quantity of gas 638 for combustion is adapted for the user's need.

The portable hair dryer 600 further comprises an ON/OFF switch 646. The ON/OFF switch 646 is disposed on the handle part 604, and is operatively connected to the computer microchip 634.

The portable hair dryer 600 further comprises an electrical power source interface 648. The electrical power source interface 648 is disposed in the handle part 604, and is for receiving a battery 650 for electrically powering the portable hair dryer 600.

The portable hair dryer 600 further comprises a battery charger 652. The battery charger 652 is operatively connected to the electrical power source interface 648, and is for charging the battery 5650 by interfacing with either a vehicle outlet jack 654 or a house current outlet 656.

The portable hair dryer 600 further comprises a mode switch 658. The mode switch 658 is operatively connected to the computer microchip 634, is disposed on the handle part 604, and is for choosing for use either electrical, gas, or both.

D. The Conclusions

It will be understood that each of the elements described above or two or more together may also find a useful application in other types of constructions differing from the types described above.

While the embodiments of the present invention have been illustrated and described as embodied in a portable hair dryer optimally having a dual heating source, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A portable hair dryer, comprising:

a) a main body;

b) a handle part; and c) a heating system;

wherein said handle part is connected to a bottom of said main body;

wherein said main body chides an air outlet;

wherein said air outlet of said main body is disposed at a front end of said main body;

wherein said main body includes an air inlet;

wherein said air inlet said main body has a net thereat;

wherein said air inlet of said main body is disposed at a rear of said main body;

wherein said heating system is at least one of gas operated and electrically operated further comprising a motor;

wherein said motor is disposed inside said main body; and wherein said motor has a transmission shaft, further comprising a fan; and wherein said fan disposed on said transmission shaft of said motor, further comprising a heating coil heat exchanger;

wherein said heating coil heat exchanger is disposed in front of said fan;

wherein said heating coil heat exchanger is disposed inside said main body; and wherein said heating coil heat exchanger is for generating heat, further comprising a combustion chamber;

wherein said combustion chamber is disposed under said heating coil heat exchanger;

wherein said combustion chamber is for gas to be combusted therein, further comprising a temperature sensor;

wherein said temperature sensor is disposed below said heating coil heat exchanger;

wherein said temperature sensor is operationally associated with a valve via a computer microchip, further comprising a temperature selector;

wherein said temperature selector is operatively connected to said computer microchip;

wherein selector is for controlling temperature of said portable hair dryer;

wherein said valve is for controlling an outflow quantity of gas; and wherein said valve is connected with a gas fitted in said handle part, which in turn is for receiving a gas cartridge further comprising a flame nozzle; and wherein said flame nozzle is disposed in front of said valve;

wherein said temperature selector is operated by a user to set a desired temperature;

wherein said temperature sensor senses a temperature to make said valve move in accordance with a set desired temperature value such that the outflow quantity of gas for combustion is adapted for the user's need, further comprising an ON/OFF switch;

wherein said ON/OFF is disposed on said handle part;

wherein said ON/OFF is operatively connected to said computer microchip, further comprising an electrical power source interface;

wherein said electrical power source interface is disposed in said handle part; and wherein said electrical power source interface is for receiving a battery for electrically powering said portable hair dryer, further comprising a battery charger;

wherein said battery charger is operatively connected to said electrical power source interface; and wherein said battery charger is for charging the battery by interfacing with one of a vehicle outlet jack and a house current outlet, further comprising a mode switch;

wherein said mode switch is operatively connected to said computer microchip;

wherein said mode switch is disposed on said handle part; and wherein said mode switch is for choosing for use of one of electrical, gas, and both.

* * * * *